US006647217B2

(12) United States Patent
Tomatsu

(10) Patent No.: US 6,647,217 B2
(45) Date of Patent: Nov. 11, 2003

(54) THERMAL FIXING DEVICE THAT AVOIDS OVERHEATING AND IMAGE FORMING DEVICE HAVING THE THERMAL FIXING DEVICE

(75) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/987,176

(22) Filed: Nov. 13, 2001

(65) Prior Publication Data

US 2002/0057919 A1 May 16, 2002

(30) Foreign Application Priority Data

Nov. 13, 2000 (JP) ..... 2000-345487

(51) Int. Cl.[7] ..... G03G 15/20
(52) U.S. Cl. ..... 399/33; 399/69
(58) Field of Search ..... 399/33, 69, 328, 399/334; 219/216

(56) References Cited

U.S. PATENT DOCUMENTS 4,914,476 A * 4/1990 Nishitsuji et al. ..... 219/216 X
4,968,872 A * 11/1990 Kusumoto ..... 399/33 X
5,329,342 A * 7/1994 Shirai et al. ..... 219/216 X
5,386,272 A * 1/1995 Nakazato ..... 219/216 X
5,754,917 A * 5/1998 Fromm et al. ..... 399/33
5,890,031 A * 3/1999 Yokota et al. ..... 399/69

FOREIGN PATENT DOCUMENTS

JP 5-188824 7/1993

* cited by examiner

*Primary Examiner*—William J. Royer
(74) *Attorney, Agent, or Firm*—Oliff & Berridge, PLC

(57) ABSTRACT

In a thermal fixing device, a thermister, a temperature fuse and a thermostat are disposed in alignment with symmetrical positions spaced by a predetermined distance from the axial center of a heat roller, that is, a temperature distribution center of a heater. Accordingly, the temperature fuse and the thermostat can sense substantially the same temperature as that sensed by the thermister, and the temperature fuse and the thermostat function as thermal cutoff devices promptly and properly to prevent the heat roller from overheating when the heat roller is excessively heated.

26 Claims, 9 Drawing Sheets

THERMAL FIXING DEVICE THAT AVOIDS OVERHEATING AND IMAGE FORMING DEVICE HAVING THE THERMAL FIXING DEVICE

BACKGROUND OF THE INVENTION

1. Field of Invention

The invention relates to a thermal fixing device and an image forming device having a thermal fixing device. Specifically, the invention relates to a thermal fixing device that can promptly and properly prevent itself from overheating when the thermal fixing device is excessively heated due to a malfunction of a control circuit or other defects, and the invention also relates to an image forming device having such a thermal fixing device.

2. Description of Related Art

An image forming device, such as a laser printer, is typically provided with a thermal fixing device having a heat roller and a pressure roller in order to fix transferred toner onto a sheet. While the sheet with a transferred toner image is passing between the heat roller and the pressure roller, the thermal fixing device thermally melts the toner and fixes it onto the sheet as a fixed toner image.

A heater lamp is typically build in a heat roller of such a thermal fixing device, as recited in Japanese Laid-Open Publication No. 5-188824. Additionally, a temperature sensor, such as a thermister, is disposed around the heat roller. The temperature of the heat roller is sensed by the temperature sensor. The heat roller is kept at a generally constant temperature by a control circuit that turns on/off the power source of the heater lamp based on the temperature sensed by the temperature sensor.

When temperature control of the heat roller is disabled due to a malfunction of the control circuit or other defects, a thermal runaway may occur. When the power source of the heater lamp cannot be turned off, the temperature of the heat roller keeps rising. To prevent overheating caused by such a thermal runaway, a current circuit breaker, such as a temperature fuse and a thermostat, is provided around the heat roller. The electric circuit breaker forcibly interrupts power supply to the heater lamp upon sensing a temperature beyond a specified temperature. As disclosed in Japanese Laid-Open Publication No. 5-188824, the temperature sensor and the temperature fuse are disposed at one end of the heat roller.

Usually, as shown in FIG. 6, temperature distribution curves of the heater at the ends of the heat roller differ greatly depending on whether the heating is started or stabilized. In addition, the temperature of the heat roller differs greatly between its center and its ends. For these above-mentioned reasons, accurate sensing of the temperature of the heat roller hardly attains to the accuracy of the thermal fixing device recited in Japanese Laid-Open Publication No. 5-188824. If the temperature of the heat roller cannot be accurately sensed, it would be difficult to keep the temperature required for thermal fixing at a generally constant temperature and to activate the temperature fuse accurately.

SUMMARY OF THE INVENTION

In view of the foregoing, the invention provides a thermal fixing device that can accurately sense the temperature of a heat roller and activate a thermal cutoff device promptly and properly when the heat roller is excessively heated. The invention also provides an image forming device having such a thermal fixing device.

According to one aspect of the invention, a thermal fixing device includes a roller, a heater that heats the roller, a temperature sensor provided around the roller to sense a temperature of the roller, and a thermal cutoff device provided around the roller to interrupt power supply to the heater. The heater has a temperature distribution that is symmetrical in an axial direction of the roller with respect to a temperature distribution center, and the temperature sensor and the thermal cutoff device are disposed facing a surface of the roller in alignment with the symmetrical positions spaced by a predetermined distance, in the axial direction of the roller, from the temperature distribution center.

With this configuration, the thermal cutoff device can sense substantially the same temperature as that sensed by the temperature sensor. Accordingly, the upper limit temperature at which the thermal cutoff device functions can be set closer to the upper limit of the control temperature and, as a result, the thermal cutoff device can promptly and properly prevent the roller from overheating.

BRIEF DESCRIPTION OF THE DRAWINGS

A preferred embodiment of the invention will be described with reference to the following figures wherein.

DETAILED DESCRIPTION OF PREFERRED EMBODIMENTS

Figure 1:
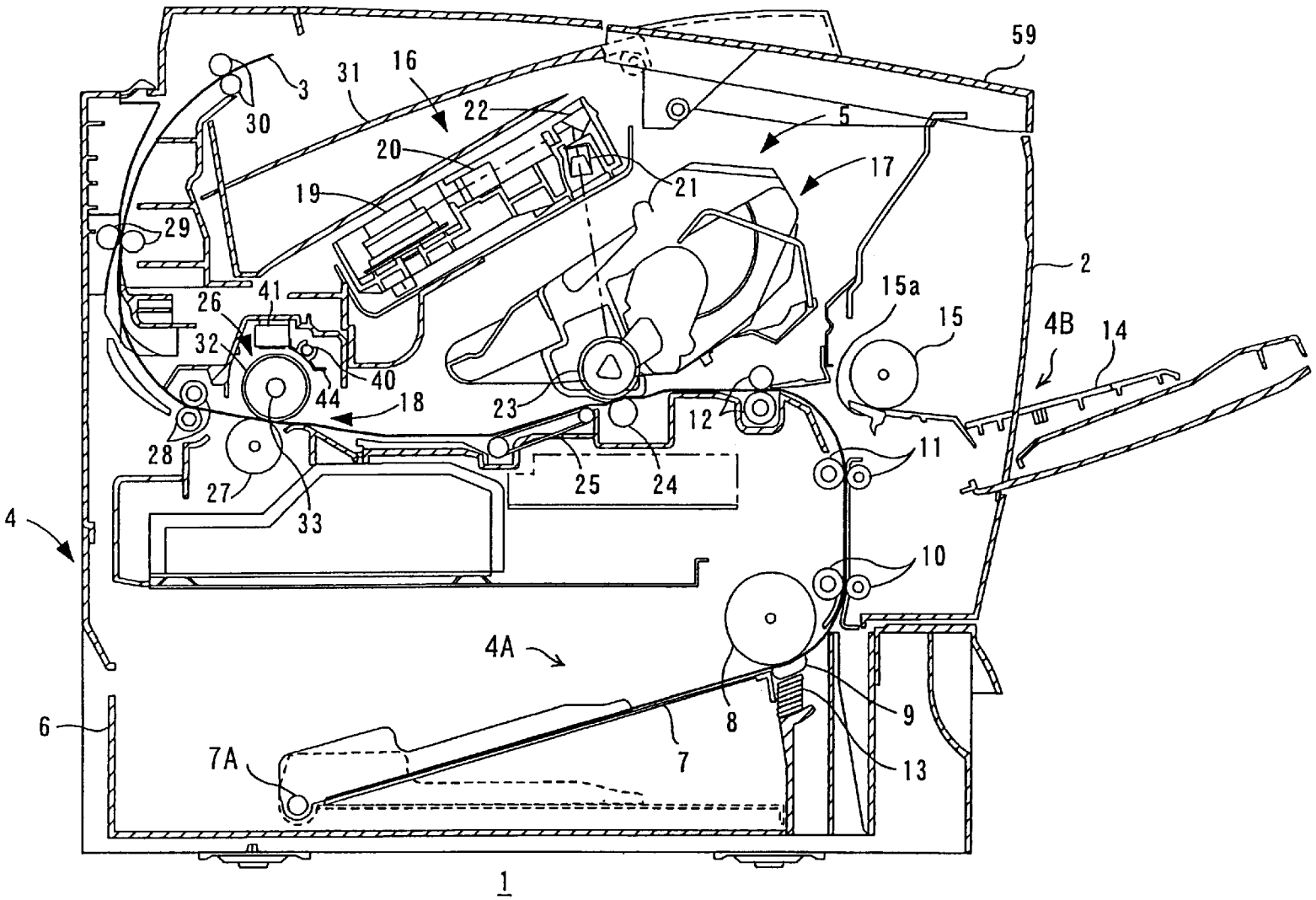
FIG. 1 is a cross-sectional side view of the substantial parts of a laser printer as an image forming device according to one embodiment of the invention.

FIG. 1 is a cross-sectional side view of the substantial parts of a laser printer as an image forming device according to one embodiment of the invention. In FIG. 1, the laser printer 1 has a feeder unit 4 that feeds a sheet 3 into a body casing, and an image forming unit 5 that forms a toner image on a sheet 3.

The feeder unit 4 is mainly made up of a first feeder unit 4A disposed at the bottom in a body casing 2 and a second feeder unit 4B disposed on the side of the body casing 2. The first feeder unit 4A includes a sheet feed tray 6 detachably attached to the body casing 2, a sheet presser plate 7, a sheet feed roller 8, a sheet feed pad 9, conveyor rollers 10, 11, and register rollers 12. The sheet feed roller 8 and the sheet feed pad 9 are disposed above one end of the sheet feed tray 6. The conveyor rollers 10, 11 are disposed downstream of the sheet feed roller 8, in the sheet feed direction. Hereinafter, upstream and downstream in the sheet feed direction is simply referred to as upstream and downstream. The register rollers 12 are disposed downstream of the conveyor rollers 10, 11.

The sheet presser plate 7 provided in the sheet feed tray 6 allows the sheet 3 to be stacked thereon. The sheet presser plate 7 is supported, at its end remote from the sheet feed roller 8, by a shaft 7A so as to be pivotable about the shaft 7A. Accordingly, the sheet presser plate 7 is vertically movable at its end closer to the sheet feed roller 8. The sheet presser plate 7 is urged upward from its reverse side by a spring (not shown). When the stack of sheets 3 is increased in quantity, the sheet presser plate 7 swings downward about the shaft 7A at its end remote from the sheet feed roller 8, against the urging force from the spring. The sheet feed roller 8 and the sheet feed pad 9 are disposed facing each other. The sheet feed pad 9 is urged toward the sheet feed roller 8 by a spring 13 disposed on the reverse side of the sheet feed pad 9.

An uppermost sheet 3 in the stack on the sheet presser plate 7 is pressed against the sheet feed roller 8 by the spring provided on the reverse side of the sheet presser plate 7, and the uppermost sheet 3 is pinched between the sheet feed roller 8 and the sheet feed pad 9 when the sheet feed roller 8 rotates. Thereafter, the uppermost sheet 3 is fed separately from the rest of the sheets. The fed sheet 3 is conveyed by the conveyor rollers 10, 11 to the register rollers 12. The register rollers 12 are made up of two rollers register the sheet 3 in a predetermined manner to correct its orientation and to convey the print sheet 3 to the image forming unit 5.

The second feeder unit 4B includes a multipurpose tray 14, sheet feed roller 15, and a sheet feed pad 15*a*. The sheet feed roller 15 feeds the sheet 3 staked on the multipurpose tray 14. The sheet feed roller 15 and the sheet feed pad 15*a* are disposed facing each other. The sheet feed pad 15*a* is urged toward the sheet feed roller 15 by a spring (not shown) disposed on the reverse side of the sheet feed pad 15*a*. The uppermost sheet 3 in the stack on the multipurpose tray 7 is pinched between the sheet feed roller 15 and the sheet feed pad 15*a* when the sheet feed roller 15 rotates. Thereafter, the sheet 3 is fed separately from the rest of the sheets. The fed sheet 3 is conveyed to the register rollers 12. The register rollers 12 correct the orientation of sheet 3 and then convey it to the image forming unit 5, in the same manner as for the sheet fed from the first feeder unit 4A.

The image forming unit 5 includes a scanner unit 16, a process cartridge 17, a transfer roller 24, and a thermal fixing device 18.

The scanner unit 16 is provided in the upper portion of the body casing 2 with a laser emitter (not shown), a rotatable polygonal mirror 19, lenses 20, 21, and a reflecting mirror 22. A laser beam that is emitted from the laser emitter based on user-specified image data sequentially passes through or reflects by the optical elements, that is, the polygonal mirror 19, the lens 20, the reflecting mirror 22, the lens 21, in the order indicated by a broken line. The laser beam is thus directed to and high-speed scanned over a photosensitive drum 23 of the process cartridge 17 (described later) for irradiation of the surface of the photosensitive drum 23.

The process cartridge 17 is disposed below the scanner unit 16 and is detachably attached to the body casing 2. When a user attaches/detaches the process cartridge 17 to/from the laser printer 1, a cover 59 provided at the top of the body casing 2 should be opened. The process cartridge 17 has the photosensitive drum 23, a scorotron charger (not shown), a developing roller (not shown), and a toner box (not shown).

The toner box contains positively charged, non-magnetic one-component toner as a developing agent. An evenly thin layer of toner is carried over the developing roller.

Meanwhile, the photosensitive drum 23 is rotatably disposed to face the developing roller. The photosensitive drum 23 is grounded, and its surface is formed as a positively charged photosensitive layer mainly made of polycarbonate.

The surface of the photosensitive drum 23 is evenly positively charged by the scorotron charger when the photosensitive drum 23 rotates. The photosensitive drum 23 is then exposed to a laser beam scanned at high speed by the scanner unit 16. As a result, an electrostatic latent image is formed based on predetermined image data. Thereafter, when the photosensitive drum 23 comes to face the developing roller, the positively charged toner on the developing roller is selectively transferred and deposited onto the electrostatic latent image formed on the surface of the photosensitive drum 23, that is, portions of the surface of the photosensitive drum 23 have a reduced electric potential due to exposure to the laser beam. As a result, the electrostatic latent image on the photosensitive drum 23 is visualized by the toner.

The transfer roller 24 is rotatably disposed below the photosensitive drum 23 in the body casing 2 and facing the photosensitive drum 23. The transfer roller 24 is formed by covering a metallic roller shaft with an electrically conductive rubber roller. A predetermined transfer bias is applied to the photosensitive drum 23. Therefore, the visible toner image carried on the photosensitive drum 23 is transferred onto the sheet 3 when the sheet 3 is conveyed between the photosensitive drum 23 and the transfer roller 24. The sheet 3 with the transferred visible image is conveyed to the thermal fixing device 18 with the aide of a conveyor belt 25.

The thermal fixing device 18 is disposed downstream of the process cartridge 17 and has a heat roller 26 and a pressure roller 27 opposed to the heat roller 26. While the sheet 3 with the transferred toner image is passing between the heat roller 26 and the pressure roller 27, the toner thermally melts and becomes fixed onto the sheet 3.

After that, the sheet 3 onto which the toner image has been fixed is conveyed to ejecting rollers 30 by conveyor rollers 28, 29 disposed downstream of the thermal fixing device 18. The sheet 3 is then ejected by the ejecting rollers 30 onto an output tray 31 disposed at an upper portion of the body casing 2.

Figure 2:
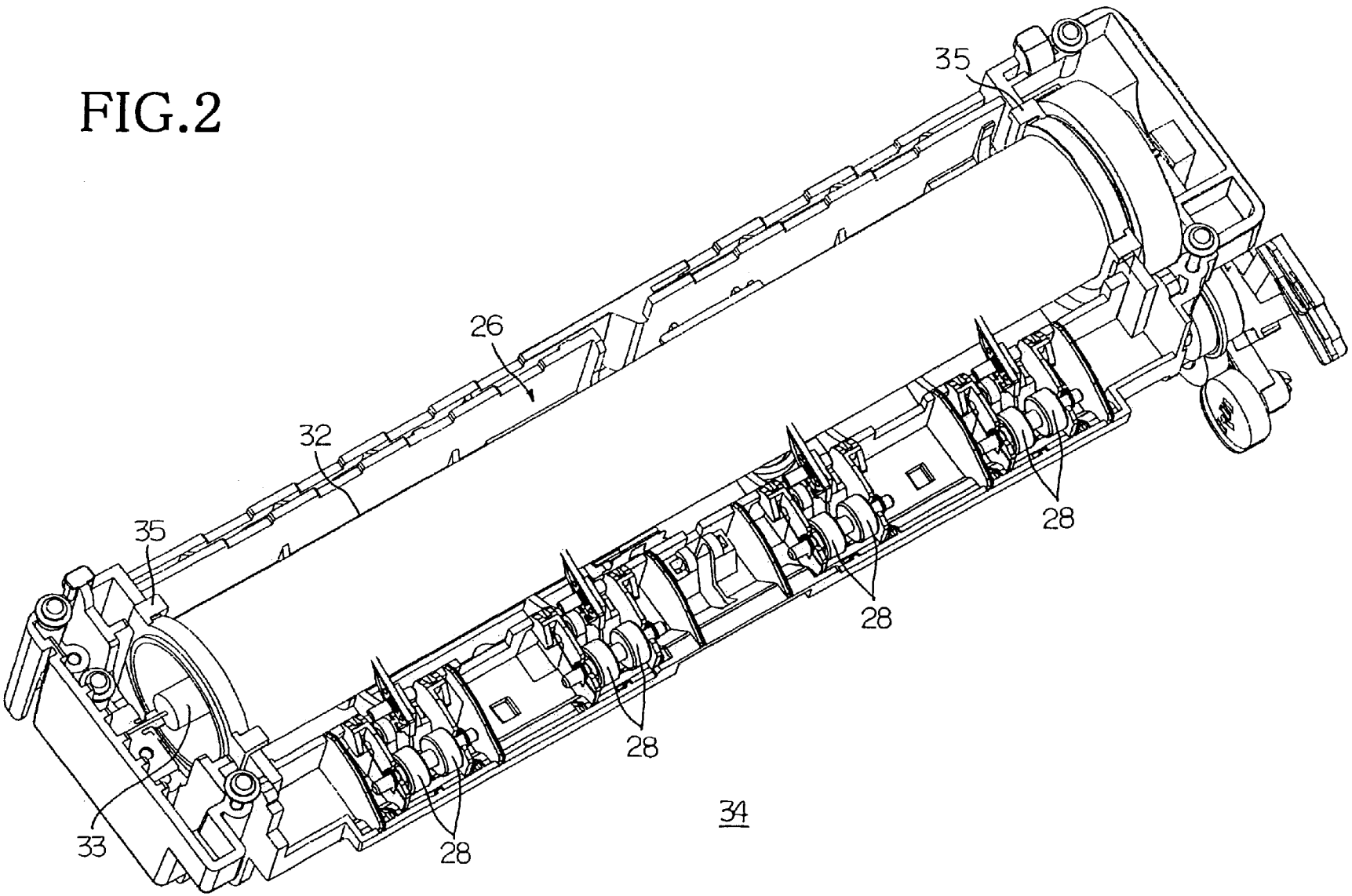
FIG. 2 is a perspective view of a casing member of a thermal fixing device in the laser printer of FIG. 1, where a heat roller is mounted on the casing member.
Figure 3:
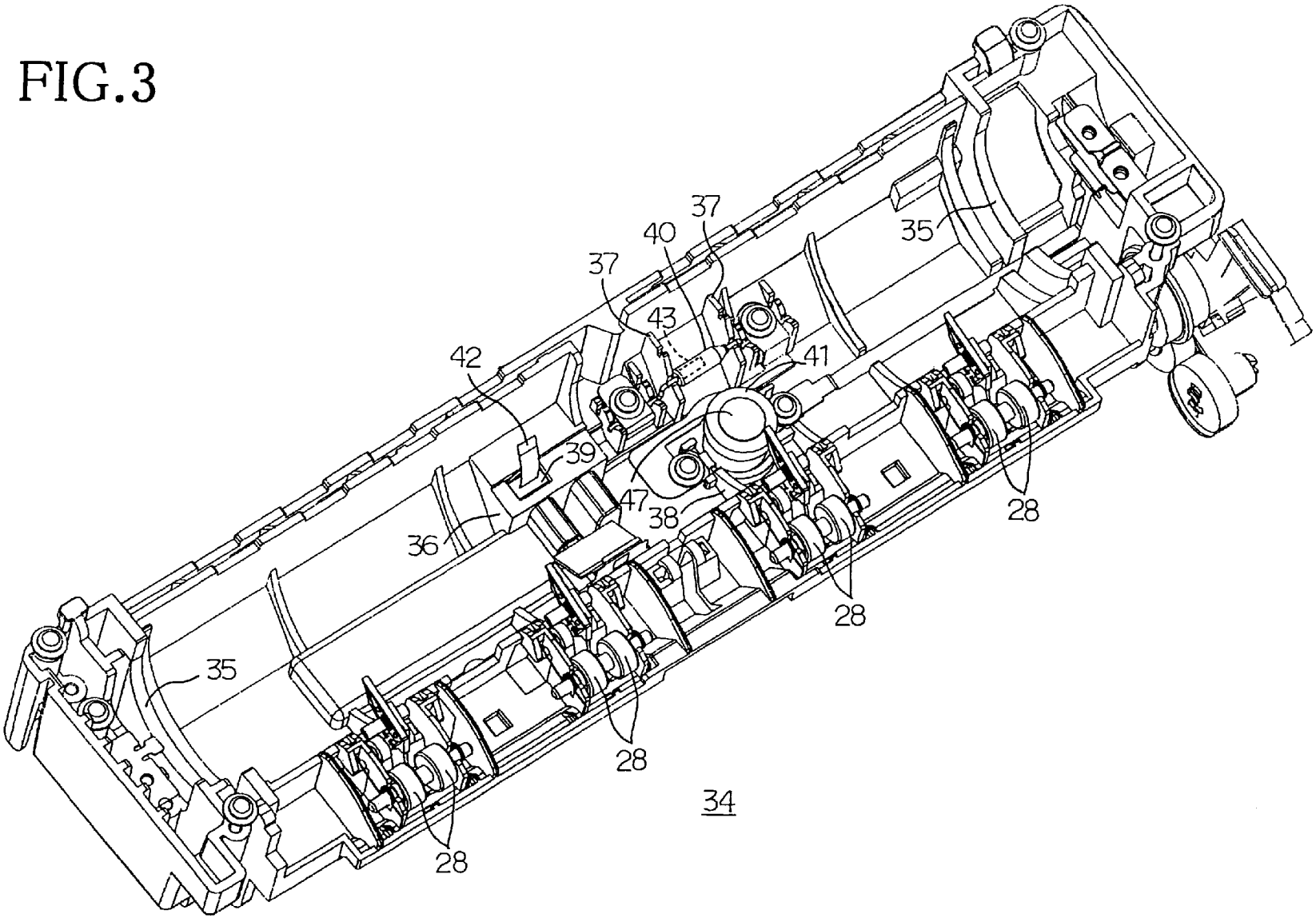
FIG. 3 is a perspective view of the casing member of the thermal fixing device in the laser printer of FIG. 1, where the heat roller is removed from the casing member.
Figure 4:
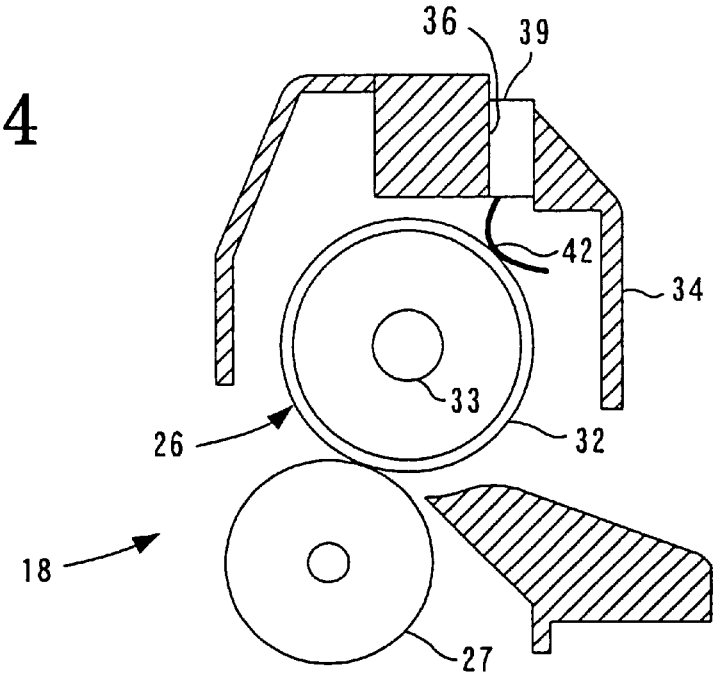
FIG. 4 is a cross-sectional side view of a thermister of the thermal fixing device in the laser printer of FIG. 1.
Figure 5:
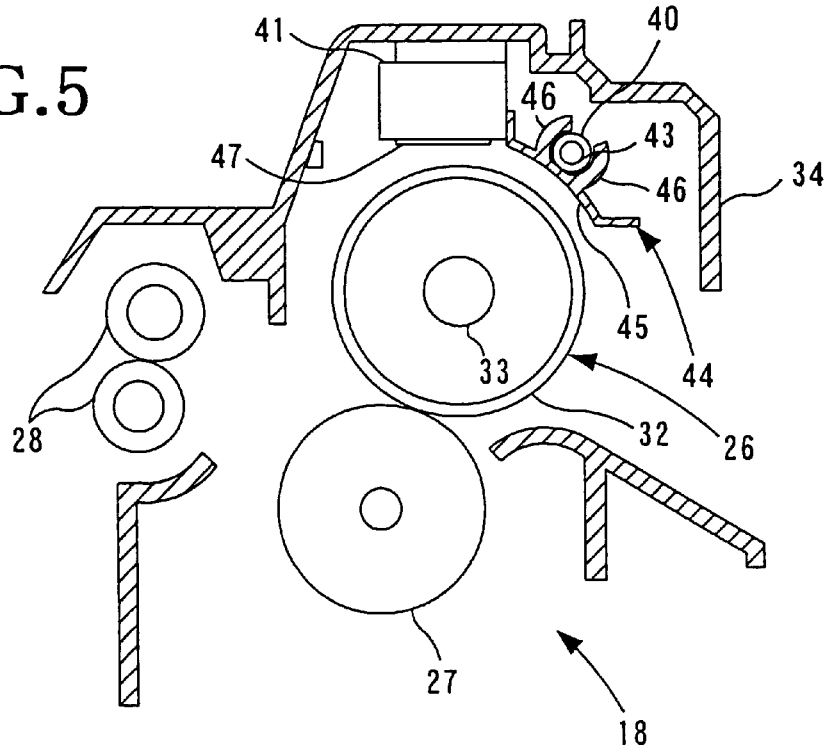
FIG. 5 is a cross-sectional side view of a temperature fuse and a thermostat of the thermal fixing device in the laser printer of FIG. 1.

As shown in FIG. 2, the heat roller 26 of the thermal fixing device 18 has a metallic roller body 32 and a heater 33 provided inside the roller body 32 in the axial direction thereof. The roller body 32 is rotatably supported by a casing member 34 of the body casing 2. As shown in FIGS. 3–5, the casing member 34 extends along the axial direction of the heat roller 26 disposed in the body casing 2 and is generally C-shaped in cross section and open downwardly. As shown in FIG. 2, holders 35 are formed at both longitudinal sides of the casing member 34 to support the roller body 32. In addition, as shown in FIG. 3, a thermister mount 36, a temperature fuse mount 37, and a thermostat mount 38 are formed at predetermined midpoints along the longitudinal direction of the casing member 34 so as to receive a thermister 39, a temperature fuse 40, and a thermostat 41, respectively. A plurality of conveyor rollers 28 are rotatably supported by the casing member 34.

As shown in FIG. 2, the roller body 32 is cylindrical and is accommodated in the casing member 34 while being rotatably supported, at its both ends, by the holders 35 of the casing member 34.

Figure 6:
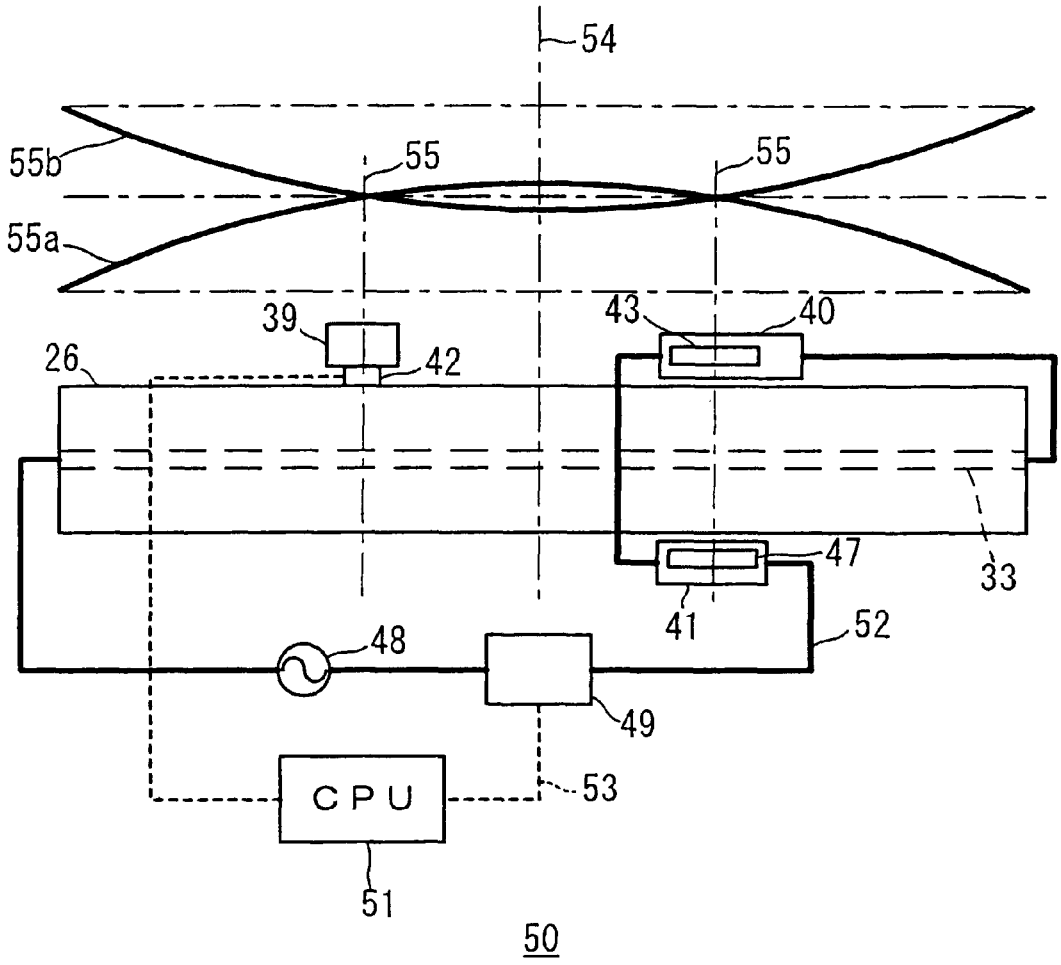
FIG. 6 is a block diagram showing locations of the components of the thermal fixing device and a heater control circuit in the laser printer of FIG. 1, where a thermister is arranged symmetrically to a temperature fuse and a thermostat.

As shown in FIG. 2, the heater 33 is provided inside the roller body 32 coaxially with the roller body 32 and extends along the length of the roller body 32. As shown in FIG. 6, the heater 33 has, during heating, temperature distributions (indicated by distribution curves 55*a*, 55*b*), each of which is symmetrical with respect to an axial center (which is aligned with a center line 54) of the heat roller 26. The temperature of the heater 33 becomes excessively higher at its longitudinal center than at its both ends when heating is started by the heater 33. Therefore, the temperature of the heater 33 is set to be much higher at its both ends than at its longitudinal center when heating is stabilized. As a result, the heater 33 is controlled such that the temperature is slightly higher at its longitudinal center than at its both ends when heating is started, and that the temperatures are slightly higher at its both ends than at its longitudinal center when heating is stabilized. Temperature distributions under such temperature control when heating is started and stabilized are indicated by the distribution curves 55*a* and 55*b*, respectively.

Symmetrical positions 55, that is, intersections of the temperature distribution curves 55*a*, 55*b* vary among heaters depending on their characteristics. Accordingly, to implement the invention, symmetrical positions 55 should be determined based on obtained temperature distribution curves.

In the thermal fixing device 18, the thermister 39, the temperature fuse 40, and the thermostat 41 are disposed facing the surface of the roller body 32 at a predetermined distance from the surface of the roller body 32. The thermister 39 is a temperature sensor that senses the temperature of the heat roller 26. The temperature fuse 40 and the thermostat 41 are thermal cutoff devices that prevent overheating from a thermal runaway when temperature control is disabled by a malfunction of a heater control circuit 50 or other defects. As shown in FIGS. 3 and 6, the thermister 39, the temperature fuse 40, and the thermostat 41 are symmetrically disposed in alignment with positions spaced by a predetermined distance, in the axial direction of the heat roller 26, from the center of the heat roller 26, that is, the temperature distribution center of the heater 33. In other words, the thermister 39, the temperature fuse 40, and the thermostat 41 are aligned with symmetrical positions 55 where the distribution curves 55*a*, 55*b* intersect each other. Additionally, the temperature fuse 40 and the thermostat 41 are disposed coaxially with the roller body 32 and on the same circumference about the central axis of the roller body 32. The thermister 39 and the temperature fuse 40 are disposed in the same plane including the axis of the heat roller 26, that is, they are disposed above the roller body 32 and along the axis of the heat roller 26.

As shown in FIGS. 3 and 4, the thermister 39 is mounted on the thermister mount 36 of the casing member 34. The thermister 39 has a temperature sensing element 42 arranged to make contact with the surface of the roller body 32. Accordingly, the thermister 39 can accurately sense the temperature of the heat roller 26.

As shown in FIGS. 3 and 5, the temperature fuse 40 has an elongated cylindrical shape and is mounted at its both ends on the temperature fuse mount 37 of the casing member 34 in a direction generally parallel to the axis of the heat roller 26. The temperature fuse 40 has a resin portion 43 as a temperature sensing element that melts at a predetermined upper limit temperature. When the resin portion 43 melts, the current passing the temperature fuse 40 is interrupted.

The temperature fuse 40 is partially covered by a fuse cover 44. The fuse cover 44 is made of an electrically insulating resin material and has a curved rectangular heat-absorbing plate 45 whose curvature matches that of the surface of the roller body 32 and a pinching member 46 that pinches the temperature fuse 40. The pinching member 46 is disposed on the opposite side of the fuse cover 44 from the heat roller 26 and pinches the resin portion 43 of the temperature fuse 40. Thus, the temperature fuse 40 is disposed facing the heat roller 26 while being covered by the heat-absorbing plate 45.

The electrical insulating fuse cover 44 interposed between the roller body 32 and the temperature fuse 40 allows the temperature fuse 40 to face the roller body 32 while leaving a reduced insulation distance therebetween. Accordingly, the thermal fixing device 18 can be made compact. In addition, by way of heat collecting by the roller body 32 through the large area heat-absorbing plate 45, and by way of transferring the corrected heat directly from the pinching member 46 to the resin portion 43 of the temperature fuse 40, the temperature can be sensed with high accuracy.

As shown in FIGS. 3 and 5, the thermostat 41 is generally disk-shaped and has on its surface a bimetal 47 as a temperature sensing element. When the bimetal 47 senses a predetermined upper limit temperature, bimetallic engagement is released to break a heater circuit 52, which will be described later. The thermostat 41 is mounted on the thermostat mount 38 of the casing member 34 such that the bimetal 47 is opposed to the roller body 32 at a predetermined distance from the roller body 32.

Additionally, the thermal fixing device 18 has the heater control circuit 50. As shown in FIG. 6, the heater control circuit 50 includes the heater circuit 52 and a control circuit 53. The heater circuit 52 is constructed by connecting a power source 48 provided in the body casing 2, the heater 33, the temperature fuse 40, and the thermostat 41 in series. A triac 49 is provided in the middle of the heater circuit 52. Meanwhile, the control circuit 53 is constructed by connecting a CPU 51 provided in the body casing 2, the thermister 39, and the triac 49. In the heater control circuit 50, the CPU 51 keeps the heat roller 26 at a predetermined control temperature by turning on/off the triac 49 to control the heater 33 based on the temperature sensed by the thermister 39. In this way, the heat roller 26 is usually kept at a predetermined control temperature.

The thermal fixing device 18 is provided with the temperature fuse 40 and the thermostat 41 as thermal cutoff devices. If the heater 33 becomes out of control due to a malfunction of the heater control circuit 50 or other defects, a thermal runaway may occur. When a thermal runaway occurs, the resin portion 43 of the temperature fuse 40 melts or a bimetallic engagement of the bimetal 47 of the thermostat 41 is released. In other words, when these thermal cutoff devices sense the upper limit temperature, they break the heater circuit 52 to prevent the heat roller 26 from overheating. When temperature control is disabled due to a malfunction of the heater control circuit 50 or other defects, at least one of the temperature fuse 40 or the thermostat 41 breaks the heater circuit 52. Thus, even when one of them is faulty, the other is going to function promptly and properly to prevent the heat roller 26 from overheating. Accordingly, in the thermal fixing device 18, overheating of the heat roller 26 is reliably prevented, and enhanced safety and reliability is ensured.

The upper limit temperature at which the resin portion 43 of the temperature fuse 40 melts and the upper limit temperature at which the bimetallic engagement of the bimetal 47 of the thermostat 41 is released are usually set higher than the upper limit control temperatures set in the CPU 51 in order to prevent the heater circuit 52 from being broken due to slight thermal fluctuations. However, in the thermal fixing device 18, as shown in FIG. 6, the thermister 39, the temperature fuse 40, and the thermostat 41 are disposed symmetrically with respect to the temperature distribution center of the heater 33. This allows the temperature fuse 40 and the thermostat 41 to sense substantially the same temperature as that sensed by the thermister 39; that is, the surface temperature of the roller body 32 is controlled with highest accuracy. Accordingly, in the thermal fixing device 18, the upper limit temperatures at which the temperature fuse 40 and the thermostat 41 functions are set closer to the upper limit control temperature set in the CPU 51. As a result, overheating of the heat roller 26 is prevented more promptly and properly.

In addition, in the thermal fixing device 18, because the thermister 39, the temperature fuse 40, and the thermostat 41 are disposed at predetermined intervals in the axial direction of the heat roller 26, the thermal fixing device 18 is then made compact.

In addition, in the thermal fixing device 18, different types of thermal cutoff devices, the temperature fuse 40 and the thermostat 41, are provided. When only two thermal cutoff devices of same type (for example, two temperature fuses 40 of same type or two thermostats 41 of same type) are provided instead, the safety and reliability cannot be ensured to a sufficient degree because one of the thermal cutoff devices (one of the temperature fuses 40 or one of the thermostats 41) becomes faulty for some reason, the other thermal cutoff devices (the other of the temperature fuses 40 or the other of the thermostats 41) is also likely to become faulty for the same reason. In contrast, by providing a different type of temperature fuse 40 from the thermostat 41, safety and reliability can be ensured to a sufficient degree. In this case, even when one of the temperature fuse 40 or the thermostat 41 becomes faulty for some reason, the other device is unlikely to become faulty for the same reason.

The temperature fuse 40 and the thermostat 41 are disposed on the same circumference about the axis of the heat roller 26, that is, disposed on the same circumference about the axis of the roller body 32 in alignment with positions identical in the temperature distribution of the heater 33. Thus, the temperature fuse 40 and the thermostat 41 can sense the actual temperature of heat roller 26, and the difference between the temperatures sensed by the temperature fuse 40 and the thermostat 41 is reduced. This effectively prevents the temperature fuse 40 and the thermostat 41 from functioning separately. Accordingly, the temperature fuse 40 and the thermostat 41 function with high accuracy while ensuring safety and reliability to a sufficient degree. Therefore, by providing the temperature fuse 40 and the thermostat 41 on the same circumference, the thermal fixing device 18 is also made compact.

In the thermal fixing device 18, the thermister 39 and the temperature fuse 40 are disposed in the same plane including the axis of the heat roller 26, that is, disposed above the roller body 32 and along the axis of the heat roller 26. When the ambient temperature at a portion above the roller body 32 in the body casing 2 differs from that at a portion below the roller body 32, the temperature fuse 40 can at least sense substantially the same temperature as the temperature sensed by the thermister 39. Thus, the upper limit temperature at which the functions of temperature fuse 40 can be set very close to the upper limit control temperature. As a result, overheating of the heat roller 26 can be prevented more promptly and properly. Eventually, by disposing the thermister 39 and the temperature fuse 40 in the same plane including the axis of the heat roller 26, the available space in the same plane is effectively used and the thermal fixing device 18 is then made more compact.

In the thermal fixing device 18, the temperature sensing elements of the temperature fuse 40 and the thermostat 41, that is, the resin portion 43 and the bimetal 47 are disposed facing the surface of the roller body 32 in alignment with positions symmetrical to the temperature sensing element 42 of the thermister 39 and are spaced by a predetermined distance from the temperature distribution center of the heater 33. This allows the temperature fuse 40 and the thermostat 41 to sense substantially the same temperature as that sensed by the thermister 39. Accordingly, the functions of the temperature fuse 40 and the thermostat 41 can be set much closer to the upper limit control temperature, and overheating of the heat roller 26 is prevented much more promptly and properly.

Additionally, in the thermal fixing device 18, because the heater 33 has the temperature distribution that is symmetrical with respect to the axial center of the heat roller 26, the thermister 39, the temperature fuse 40, and the thermostat 41 are disposed symmetrically with respect to the axial center of the heat roller 26. This simplifies the design and configuration of the thermal fixing device 18.

Moreover, the laser printer 1 having the above-described thermal fixing device 18 can be made compact, and the safety and reliability of the laser printer 1 can be enhanced by activating the temperature fuse 40 and the thermostat 41 promptly and properly.

Although, in the above-described thermal fixing device 18, the temperature fuse 40 and the thermostat 41 are provided as the thermal cutoff devices, the invention is not limited to this embodiment and two temperature fuses 20 or two thermostats 41 may be provided, instead. In this case, it is preferable to use different types of temperature fuses 40 or thermostats 41 obtained from different production lots.

As described above, it is unpreferable to use two temperature fuses 40 or two thermostats 41 obtained from the same production lot because if one of the temperature fuses 40 or one of the thermostats 41 becomes faulty for some reason, the other temperature fuse 40 or the other thermostat 41 is also likely to become faulty for the same reason.

In contrast, by using two different types of temperature fuses 40 or thermostats 41 obtained from different production lots, the safety and reliability of the thermal fixing device 18 can be ensured to a sufficient degree. In this case, even when one of the temperature fuses 40 or the thermostats 41 becomes faulty for some reason, the other temperature fuse 40 or thermostat 41 is unlikely to become faulty for the same reason.

Figure 7:
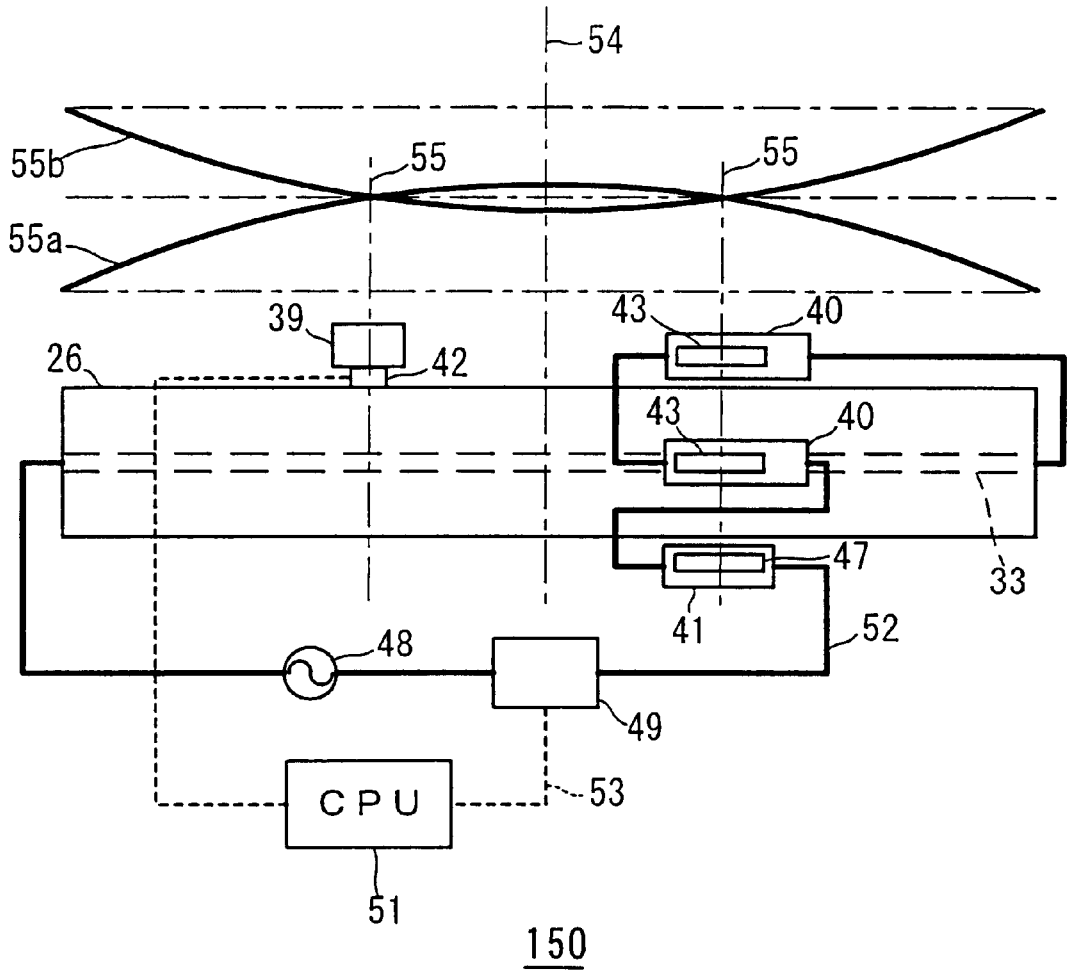
FIG. 7 is a block diagram showing locations of the components of the thermal fixing device and a heater control circuit in the laser printer of FIG. 1, where a thermister is arranged symmetrically to two temperature fuses and a thermostat.

Instead of providing two thermal cutoff devices, only one thermal cutoff device or three or more thermal cutoff devices may be provided. FIG. 7 shows a heater control circuit 150 provided with three thermal cutoff devices. In this case, three thermal cutoff devices are disposed on the same circumference about the axis of the heat roller 26 symmetrically to the thermister 39 with respect to the temperature distribution center of the heater 33. In FIG. 7, two temperature fuses 40 and one thermostat 41 are shown by way of example. Alternatively, one temperature fuse 40 and two thermostats 41 may be provided.

Figure 8:
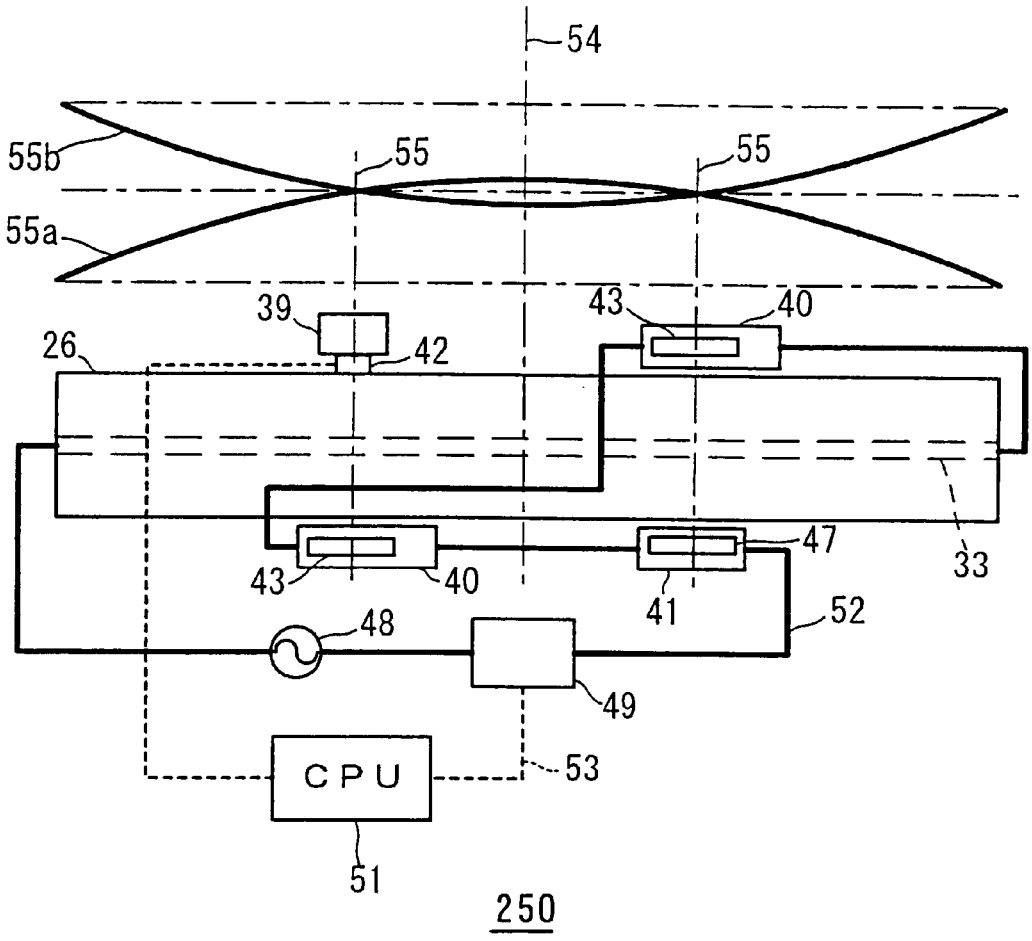
FIG. 8 is a block diagram showing locations of the components of the thermal fixing device and a heater control circuit in the laser printer of FIG. 1, where a thermister and a temperature fuse (the thermister and temperature fuse are parallel to each other) are arranged symmetrically to a temperature fuse and a thermostat.

FIG. 8 shows an alternative heater control circuit 250 where three thermal cutoff devices are provided. In this case, the thermister 39 and one thermal cutoff device are disposed symmetrically to two thermal cutoff devices with respect to the temperature distribution center of the heater 33. A temperature fuse 40 shown in FIG. 8 as the one thermal cutoff device by way of example may be replaced with a thermostat 41. A temperature fuse 40 and a thermostat 41 shown in FIG. 8 as the two thermal cutoff devices may be replaced with two temperature fuses 40 or two thermostats 41.

Figure 9:
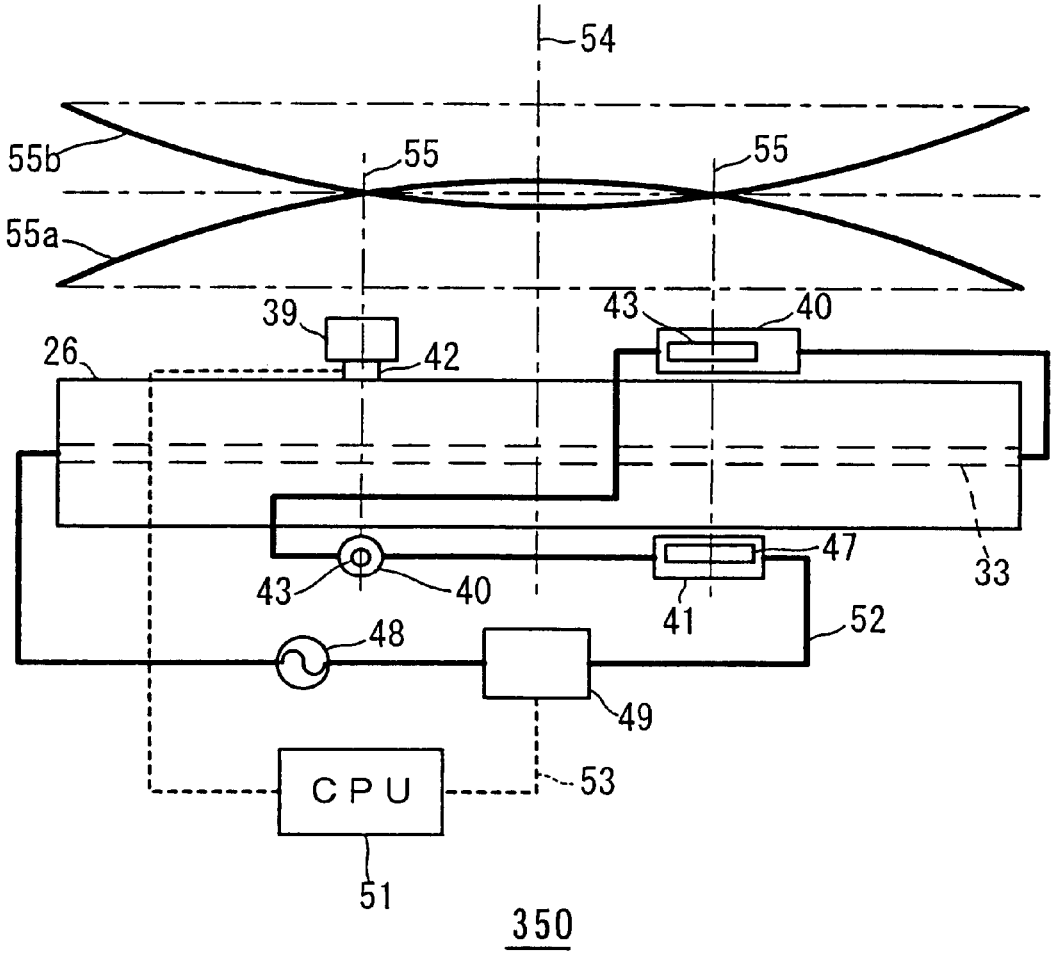
FIG. 9 is a block diagram showing locations of the components of the thermal fixing device and a heater control circuit in the laser printer of FIG. 1, where a thermister and a temperature fuse (the thermister and temperature fuse are perpendicular to each other) are arranged symmetrically to a temperature fuse and a thermostat.

The temperature fuses 40 may be oriented in any direction, instead of being oriented in a direction generally parallel to the axis of the heat roller 26, as shown in FIG. 8. For example, a heater control circuit 350 shown in FIG. 9 may be used. In the heater control circuit 350, any one of two temperatures fuses 40 is disposed generally perpendicularly to the axial direction of the heat roller 26. Alternatively, the temperature fuse 40 may be disposed slantwise with respect to the axial direction of the heat roller 26.

Although, in the above-described thermal fixing device 18, the thermister 39 and the temperature fuse 40 are disposed in the same plane including the axis of the heat roller 26, the thermister 39 and the thermostat 41 may be disposed in the same plane including the axis of the heat roller 26. The thermister 39 and the temperature fuse 40 or the thermostat 41 are not necessarily required to be disposed in the same plane including the axis of the heat roller 26. When three or more thermal cutoff devices are provided, as shown in FIG. 8, the thermister 39 and a thermal cutoff device (a temperature fuse 41 shown by way of example and without limitation) may be disposed in the same plane including the axis of the heat roller 26, and two thermal cutoff devices (a temperature fuse 40 and a thermostat 41 shown by way of example and without limitation) may be disposed in the same plane including the axis of the heat roller 26, as shown in FIG. 8.

Figure 10:
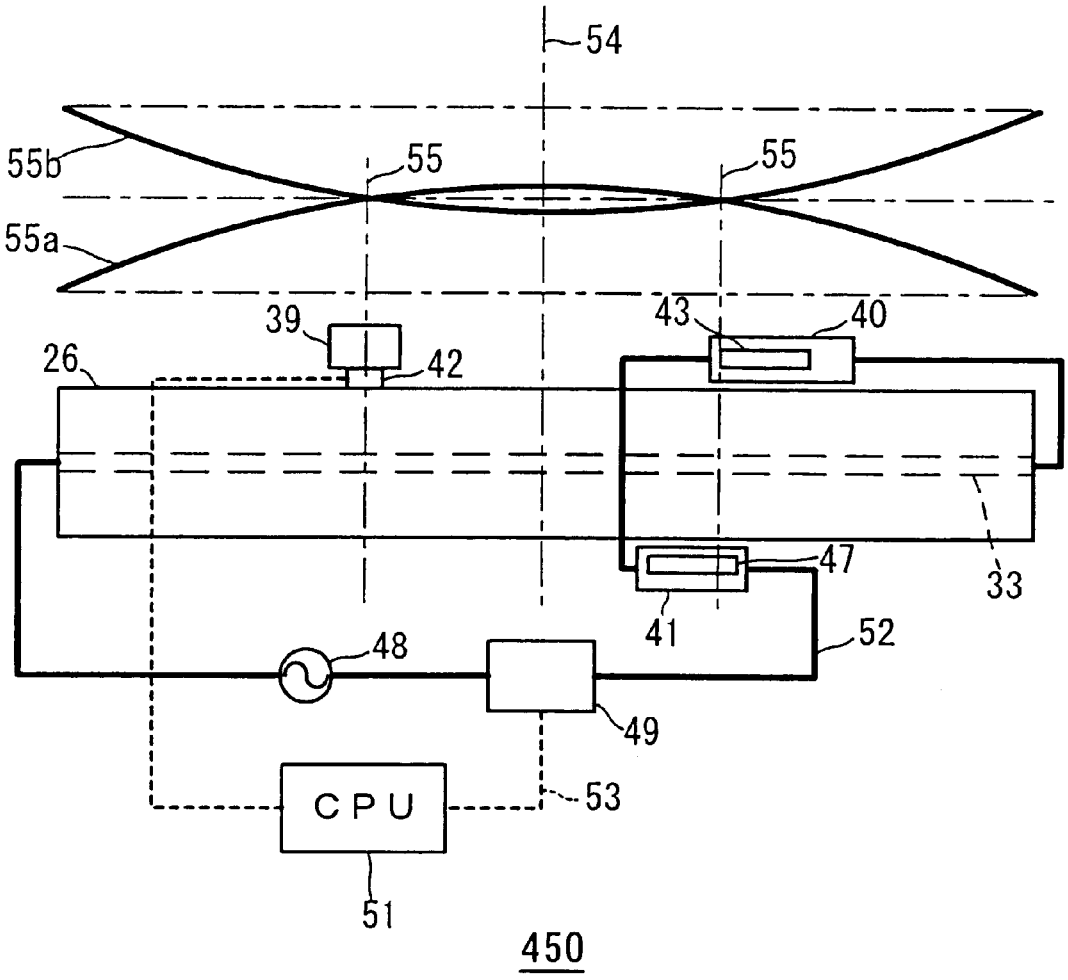
FIG. 10 is a block diagram showing the temperature fuse and the thermostat offset from the symmetrical positions shown in FIG. 6.

In the above-described thermal fixing device 18, the temperature sensing elements of the temperature fuse 40 and the thermostat 41, that is, the resin portion 43 and the bimetal 47 are disposed facing the surface of the roller body 32 in alignment with positions symmetrical to the temperature sensing element 42 of the thermister 39 and are spaced by a predetermined distance from the temperature distribution center of the heater 33. However, if the temperature fuse 40 and the thermostat 41 can sense substantially the same temperature as that sensed by the thermister 39, the temperature fuse 40 and the thermostat 41 are not required to be disposed as described above. Such a case is shown in FIG. 10. In a heater control circuit 450 in FIG. 10, the temperature fuse 40 is aligned with the symmetrical position 55, but the resin portion 43 is offset from the symmetrical position 55. In FIG. 10, the thermostat 41 is also offset from the symmetrical position 55.

In the above-described thermal fixing device 18, the heater 33 has a temperature distribution symmetrical with respect to the axial center of the heat roller 26. In a case (not shown) where the heater 33 has a temperature distribution symmetrical with respect to an offset point located a predetermined distance from the axial center of the heat roller 26, the thermister 39, the temperature fuse 40, and the thermostat 41 may be disposed symmetrically with respect to the offset point.

Although, in the above-described thermal fixing device 18, the temperature fuse 40 and the thermostat 41 are used as thermal cutoff devices, any known thermal cutoff device can be used alternatively if it breaks the heater circuit 52 upon sensing a predetermined upper limit temperature.

What is claimed is:

1. A thermal fixing device, comprising:

a roller;

a heater that heats the roller;

a temperature sensor to sense a temperature of the roller; and a thermal cutoff device to interrupt power supply to the heater based on the temperature of the roller, wherein the heater has a temperature distribution that is symmetrical in an axial direction of the roller with respect to a temperature distribution center, and the temperature sensor and the thermal cutoff device are disposed facing a surface of the roller in alignment with symmetrical positions spaced by a predetermined distance, in the axial direction of the roller from the temperature distribution center.

2. The thermal fixing device according to claim 1, wherein a plurality of thermal cutoff devices are provided as the thermal cutoff device.

3. The thermal fixing device according to claim 1, wherein at least one of the temperature sensor and the thermal cutoff device is disposed on a plane including an axis of the roller.

4. The thermal fixing device according to claim 1, wherein the thermal cutoff device has a temperature sensing element that senses a temperature, and the temperature sensing element is disposed facing the surface of the roller in alignment with a position spaced by a predetermined distance, in the axial direction of the roller from the temperature distribution center.

5. The thermal fixing device according to claim 1, wherein different types of thermal cutoff devices are provided as the thermal cutoff device.

6. The thermal fixing device according to claim 1, wherein the temperature sensor is adjacent to a thermostat.

7. The thermal fixing device according to claim 1, wherein the temperature sensor is provided proximate the roller.

8. The thermal fixing device according to claim 1, wherein the thermal cutoff device is provided proximate the roller.

9. The thermal fixing device according to claim 2, wherein the plurality of thermal cutoff devices are disposed on a circumference about an axis of the roller in alignment with positions identical in temperature in the temperature distribution.

10. The thermal fixing device according to claim 2, wherein the temperature sensor and at least one of the plurality of thermal cutoff devices are disposed on the same plane including an axis of the roller.

11. The thermal fixing device according to claim 2, wherein each of the plurality of thermal cutoff devices has a temperature sensing element that senses a temperature, and each temperature sensing element is disposed facing the surface of the roller in alignment with a position spaced by a predetermined distance, in the axial direction of the roller from the temperature distribution center.

12. The thermal fixing device according to claim 2, wherein different types of thermal cutoff devices are provided as the thermal cutoff device.

13. The thermal fixing device according to claim 9, wherein the temperature sensor and at least one of the plurality of thermal cutoff devices are disposed on the same plane including the axis of the roller.

14. The thermal fixing device according to claim 9, wherein each of the plurality of thermal cutoff devices has a temperature sensing element that senses a temperature, and each temperature sensing element is disposed facing the surface of the roller in alignment with a position spaced by a predetermined distance, in the axial direction of the roller from the temperature distribution center.

15. The thermal fixing device according to claim 9, wherein different types of thermal cutoff devices are provided as the thermal cutoff device.

16. The thermal fixing device according to claim 13, wherein each of the plurality of thermal cutoff devices has a temperature sensing element that senses a temperature, and each temperature sensing element is disposed facing the surface of the roller in alignment with a position spaced by a predetermined distance, in the axial direction of the roller from the temperature distribution center.

17. The thermal fixing device according to claim 13, wherein different types of thermal cutoff devices are provided as the thermal cutoff device.

18. The thermal fixing device according to claim 16, wherein different types of thermal cutoff devices are provided as the thermal cutoff device.

19. A thermal fixing device, comprising:

a roller;

a heater that heats the roller;

a temperature sensor provided proximate the roller to sense a temperature of the roller; and a thermal cutoff device provided proximate the roller to interrupt power supply to the heater, wherein the temperature sensor and the thermal cutoff device are disposed symmetrically with respect to an axial center of the roller, and are coplanar with the axial center of the roller.

20. A thermal fixing device, comprising:

a roller;

a heater that heats the roller;

a temperature sensor provided proximate the roller to sense a temperature of the roller; and a plurality of thermal cutoff devices proximate the roller to interrupt power supply to the heater, wherein the plurality of thermal cutoff devices are disposed on the same circumference about an axis of the roller.

21. The thermal fixing device according to claim 20, wherein the heater is provided inside the roller in the axial direction of the roller.

22. An image forming device that forms a toner image on a recording medium, comprising:

a thermal fixing device that heats and presses the recording medium having the toner image to fix the toner image onto the recording medium, the thermal fixing device comprising:

a roller;

a heater that heats the roller;

a temperature sensor provided proximate the roller to sense a temperature of the roller; and a thermal cutoff device provided proximate the roller to interrupt power supply to the heater, wherein the heater has a temperature distribution that is symmetrical in an axial direction of the roller with respect to a temperature distribution center, and the temperature sensor and the thermal cutoff device are disposed facing a surface of the roller in alignment with symmetrical positions spaced by a predetermined distance, in the axial direction of the roller from the temperature distribution center.

23. An image forming device that forms a toner image on a recording medium, comprising:

a thermal fixing device that heats and presses the recording medium having the toner image to fix the toner image onto the recording medium, the thermal fixing device comprising:

a roller;

a heater that heats the roller;

a temperature sensor provided proximate the roller to sense a temperature of the roller; and a thermal cutoff device provided proximate the roller to interrupt power supply to the heater, wherein the temperature sensor and the thermal cutoff device are disposed symmetrically with respect to an axial center of the roller, and are coplanar with the axial center of the roller.

24. An image forming device that forms a toner image on a recording medium, comprising:

a thermal fixing device that heats and presses the recording medium having the toner image to fix the toner image onto the recording medium, the thermal fixing device comprising:

a roller;

a heater that heats the roller;

a temperature sensor provided proximate the roller to sense a temperature of the roller; and a plurality of thermal cutoff devices provided proximate the roller to interrupt power supply to the heater, wherein the plurality of thermal cutoff devices are disposed on the same circumference about an axis of the roller.

25. A thermal fixing device, comprising:

a roller;

a heater that heats the roller;

a temperature sensor provided proximate the roller to sense a temperature of the roller; and a thermal cutoff device provided proximate the roller to interrupt power supply to the heater, wherein the heater has a temperature distribution that is symmetrical in an axial direction of the roller with respect to a temperature distribution center, and at least one of the temperature sensor and the thermal cutoff device is disposed facing a surface of the roller in alignment with one of symmetrical positions spaced by a predetermined distance, in the axial direction of the roller from the temperature distribution center.

26. The thermal fixing device according to claim 25, wherein the predetermined distance is a distance, in the axial direction of the roller, between the temperature distribution centers and an intersection between temperature distribution curves obtained when heating by the heater is started and when heating by the heater is stabilized.

* * * * *